US006639875B2

(12) United States Patent
Hall

(10) Patent No.: US 6,639,875 B2
(45) Date of Patent: Oct. 28, 2003

(54) TIME PIECE WITH CHANGABLE COLOR FACE

(76) Inventor: Alfred E. Hall, 14943 Hillcrest Rd., Dallas, TX (US) 75248

( * ) Notice: Subject to any disclaimer, the term of this patent is extended or adjusted under 35 U.S.C. 154(b) by 0 days.

(21) Appl. No.: 09/925,763

(22) Filed: Aug. 9, 2001

(65) Prior Publication Data

US 2002/0054541 A1 May 9, 2002

Related U.S. Application Data

(63) Continuation-in-part of application No. 09/707,623, filed on Nov. 7, 2000.

(51) Int. Cl.[7] ..... G04C 19/00; G04C 17/00
(52) U.S. Cl. ..... 368/84; 368/82; 368/242
(58) Field of Search ..... 368/81, 84, 239, 368/242

(56) References Cited

U.S. PATENT DOCUMENTS

| | | | | | |
|---|---|---|---|---|---|
| 4,274,154 | A | * | 6/1981 | Dostoomian et al. | 368/239 |
| 5,228,013 | A | * | 7/1993 | Bik | 368/223 |
| 5,636,185 | A | * | 6/1997 | Brewer et al. | 349/165 |
| 5,892,455 | A | * | 4/1999 | Matsumoto | 340/7.55 |
| 5,917,778 | A | * | 6/1999 | James et al. | 368/17 |
| 5,943,300 | A | * | 8/1999 | Johnson | 368/233 |
| RE36,662 | E | * | 4/2000 | Galison | 368/18 |

* cited by examiner

*Primary Examiner*—David Martin
*Assistant Examiner*—Michael L. Lindinger
(74) *Attorney, Agent, or Firm*—Alfred E. Hall

(57) ABSTRACT

A timepiece that has an LCD face that changes color when the time changes between the A.M. and the P.M. to provide a pleasing esthetic appearance to the user. Further, the timepiece may have a manual control such as a button that may be depressed to cause the LCD face to change to any one of several colors as desired by the user.

6 Claims, 2 Drawing Sheets

TIME PIECE WITH CHANGABLE COLOR FACE

This application is a continuation-in-part application of application Ser. No. 09/707,623 filed Nov. 7, 2000 and entitled Dual Time Zone Time Piece and commonly owned by the present applicant and incorporated herein by reference in its entirety.

BACKGROUND OF THE INVENTION

1. Field of the Invention

The present invention relates in general to time pieces for keeping time and specifically to time pieces wherein the time face of a time piece having an LCD face can selectively change color as desired by the user or can change color automatically upon a change from morning time to afternoon time. Further it relates to time pieces having at least two separate time zones to enable the user thereof to see at a glance whether the time indicated by each time piece is in the morning before 12 noon or is in the afternoon after 12 noon.

2. Description of Related Art

Time pieces having LCD faces are well known in the art. Many time pieces have numerical indicia for indicating to the user the day, date, and/or other information. Some of them have LCD faces of different color such as blue, purple, or the like. However, none of them, to applicant's knowledge, have the ability to change the color of the LCD face as desired by the user. Such watches or time pieces have a decorative or esthetic attraction inasmuch as the user can change the color of the watch face according to the desire of the user such as the type of clothes being worn or simply the whim of the user. Further, none of them, to applicant's knowledge, have the ability to change the color of the LCD face of the watch automatically when the time changes between A.M. and P.M.

Further, dual time pieces are well known in the art. They generally have, in one clock unit, two clock faces so that the dial on one face can be set to local time and the second dial on the second face can be set to a time in a different time zone. They can be mechanical watches or LCD watches.

The problem occurs when looking at the local time and then when looking at the time in the other time zone and determining whether it is in the morning or the afternoon. For instance, a traveler in Japan may set the local time to 12:00 noon while, at that same time in a location such as Dallas, Tex., the time may be 10:00 p.m. When looking at the two dials, one may wonder if the time in Dallas means 10:00 a.m. the next day or 10:00 p.m.

It would advantageous to have such an LCD watch or time piece that had an LCD face that could be selectively changed in color by the user or that would automatically change the color of the dial from a first color to a second different color upon a change in time between A.M. and P.M. Further, it would be advantageous to have a dual zone time watch that indicated on each dial face the time in a respective time zone and whether that time was in the afternoon or in the morning.

SUMMARY OF THE INVENTION

The present invention solves the problem of the prior art by having (1) an LCD watch that has an LCD face that can change color as selected by the user, (2) an LCD watch that has an LCD face that changes color automatically upon a change in time between A.M. and P.M. and (3) a dual time zone time piece that has indicia related with each dial face that indicates whether the time indicated is A.M. or P.M. This can be accomplished with either a mechanical watch or a watch having an LCD face by placing indicia on the face that indicates whether the time indicated is in the A.M. or the P.M. The indicia could be a window in which the letters a.m. or p.m. appear. In an LCD display, the color of the LCD face representing p.m. time could change to a darker color. It is well known, as described in U.S. Pat. No. 4,656,469 issued Apr. 7, 1987, that certain LCD materials will change color upon application of a different voltage to the LCD material. In this manner, the user of the watch, when looking at the two faces, will know immediately whether each of the first and second time zones is in the a.m. or the p.m. Thus, if the user is in Japan and has set local Japanese time to 10:00 a.m. on a first dial or LCD face, it will have indicia representing a.m. hours (such as a window with a.m. in it or the color of the LCD being a given color). If the second dial or LCD face is set to 3:00 a.m. in some other time zone, that dial will have indicia on it also representing a.m. hours.

Thus the user will know that when it is 10:00 a.m. where he/she is located, it is 3:00 a.m. at the other time zone. In like manner, if it is 10:00 a.m. local time in Tokyo and 3:00 p.m. in a second time zone, the user will be able to tell that the time in the second time zone is in the p.m. because of indicia that shows, such as a window with the proper A.M./P.M. letters therein or because of the different color of first LCD face from the second face.

It is an important object of the present invention to provide an LCD time piece with an LCD background face that automatically changes color, preferably from light to dark, upon a change in the time between A.M. and P.M. The liquid crystal background display is of the type that changes color when the voltage applied thereto is changed as discussed earlier. A power supply is coupled to the LCD background display for activating the liquid crystal. A settable clock circuit is coupled to the LCD background for causing time related indicia to be displayed thereon. An electronic circuit is coupled to the power supply for automatically changing the voltage applied to the LCD background display for changing the color of the display when the clock circuit indicates a change in time between A.M. and P.M.

It is another important object of the present invention to provide an LCD time piece with an LCD background that can be selectively changed in color by the user thereof to visually enhance the watch color with particular clothing or for any other reason. A control device, preferably in the form of a button on the side of the watch or time piece, can be selectively actuated (such as being depressed) to cause a change in the color of the LCD background on the watch.

It is also an object of the present invention to provide a dual zone time piece that enables the user to tell when each time zone is in the a.m. or the p.m.

It is a further object of the present invention to provide indicia on the face of each time piece that provides a visual indication of a.m. or p.m. condition.

It is still another object of the present invention to provide a dual time piece having a window in the face thereof in which a designation of morning or afternoon hours appear.

It is yet another important object of the present invention to provide a dual time piece having LCD faces in which a face showing a.m. time is of one color and the face showing p.m. time is of another color.

Thus, the invention relates to an improved LCD time piece in which the LCD background may change color automatically upon a change in time between the a.m. and the p.m. The invention has a liquid crystal background display that changes color when a voltage applied thereto is changed. A power supply is coupled to the LCD background display for activating the liquid crystal and provides a first background color. A settable clock circuit is coupled to the LCD background display for causing time related indicia to be displayed thereon. An electronic circuit is coupled to the power supply and to the settable clock circuit for changing the voltage applied to the LCD display for changing the color of the display when the clock circuit indicates a change in time between the A.M. and the P.M.

The invention also relates to an improved LCD time piece in which the LCD background color may be selectively changed by the user of the time piece whenever desired. Again, a liquid crystal background display changes color when the voltage applied thereto is changed. A power supply is selectively coupled to the background display for activating the liquid crystal to a first color. Again, a settable clock circuit is coupled to the LCD background display for causing time related indicia to be displayed thereon. A manually controlled electronic circuit is coupled between the settable clock circuit and the power supply for selectively changing the voltage applied to at least a to portion of the LCD background display to cause the at least a portion of the LCD background display to change color.

The invention also relates to a dual time piece having at least first and second time indicating units thereon for indicating time in at least first and second time zones, the improvement comprising indicia associated with each time indicating unit for providing a visual indication of whether that time indicating unit is indicating a.m. time or p.m. time.

The invention also relates to a method of telling time in two separate time zones comprising the steps of providing first and second time indicating faces; and locating indicia on each time face that shows whether the time indicated thereon is a.m. time or p.m. time.

BRIEF DESCRIPTION OF THE DRAWINGS

These and other more detailed objects of the present invention will be disclosed when taken in conjunction with the following detailed description of the drawings in which like numerals represent like elements and in which.

DETAILED DESCRIPTION OF THE DRAWINGS

Figure 1:
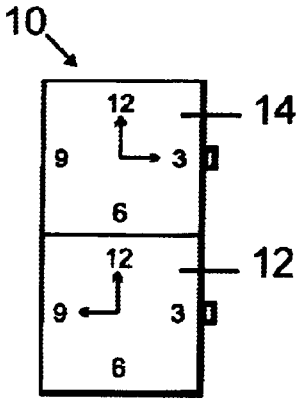
FIG. 1 is a diagrammatic representation of a dual time piece where each watch is set to a different time but with no indication of whether the time is in the a.m. or the p.m.

FIG. 1 is a diagrammatic representation of a prior art dual time piece 10 having a first watch face 12 and a second watch face 14. Watch face 12 is set with the hour hands at 9:00 o'clock while watch face 14 is set with the hour hands at 3:00 o'clock. Assume that the hands on the face 12 are set to a local time of 9:00 a.m. and that hands on the face 14 are set to some different time zone. Of course, since the hands on face 12 are set at local time, the user knows that the indicated local time is a.m. The problem illustrated is that the user does not know whether the hour hands on face 14 are a.m. or p.m. The user can, of course, calculate the difference in hours between the two time zones and in which direction, east or west, the second time zone is located and thus determine whether the second time zone is in the a.m. or p.m. However, there is no clear cut instantaneous indication of what time of day is represented by the second watch face 14.

Figure 2:
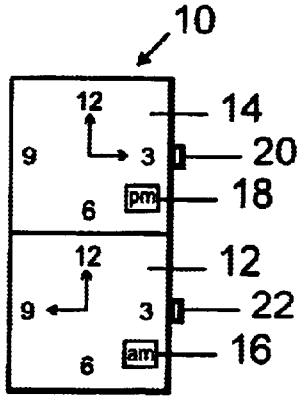
FIG. 2 is a diagrammatic representation of a dual time piece where each watch is set to a different time zone but each watch face has a window therein wherein the letters a.m. and p.m. are visible.

FIG. 2 is a diagrammatic representation of a first embodiment of the present invention in which a dual time piece 10 again has a first watch face 12 with the hour hands set to 9:00 o'clock and the second watch face 14 has the hour hands set to 3:00 o'clock. Watch face 12 has a window 16 therein with the letters "a.m." exposed. In like manner, watch face 14 has a window 18 therein with the letters "p.m." exposed therein. Thus, the user knows immediately that the time in the second time zone is 3:00 p.m. Conventional control stems 20 and 22 can be provided for setting both the time and a.m./p.m. designations in a conventional manner.

Figure 3:
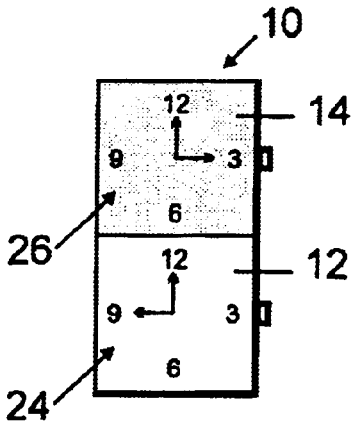
FIG. 3 is a diagrammatic representation of a dual time piece where each watch is set to a different time zone and each watch has an LCD face and wherein one face is of a different color than the face of the other LCD face to distinguish a.m. hours from p.m. hours.

FIG. 3 is a diagrammatic representation of a second embodiment of the dual time invention wherein the dual time piece 10 is comprised of two LCD watches 12 and 14. In this case, the LCD face 26 of the second time piece 14 is of a different color than the LCD face 24 of the first time piece 12 thus indicating that the time represented by the hour hands of the second time piece 14 is in the p.m. When both watch faces represent a.m., they will both be of the same first color. When both watch faces represent p.m., they will both be of the same different color. Again, the user will be able to tell whether the time indicated by the second time piece is in the a.m. or the p.m. simply by looking at the face of the dials of the timepieces 12 and 14. Preferably the first color for A.M. is a light color and the second color for the P.M. is a dark color.

Figure 4:
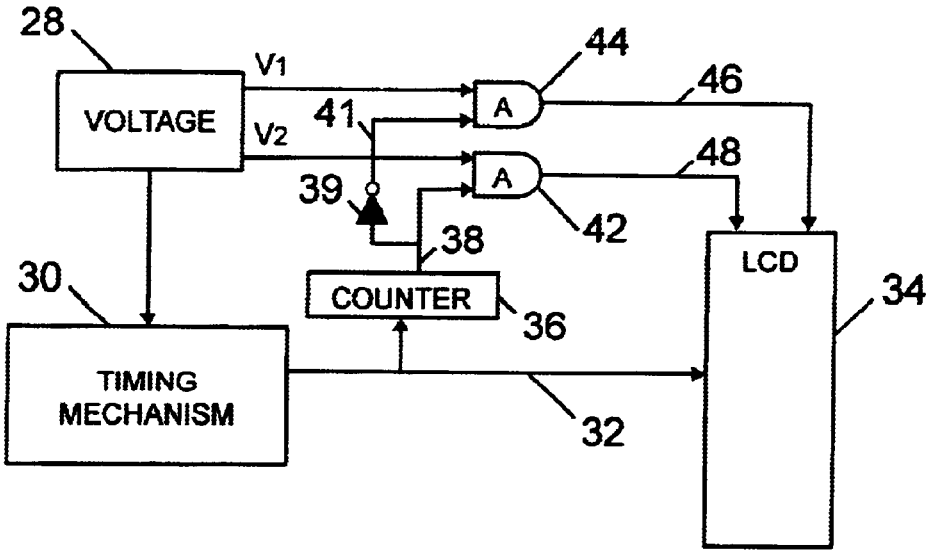
FIG. 4 is a diagrammatic representation of a simple circuit for changing the voltage to the LCD clock face to change its color at 12:00 noon and a 12;00 midnight.

A simple circuit for changing the voltage applied to the LCD is shown in FIG. 4. A voltage source 28 powers a timing mechanism 30, of any well known type, to cause it to provide an output on line 32 that enables the proper time to be shown on the LCD display 34. A counter 36 generates an output on line 38 when a count of 12, representing 12 noon is received. Prior to the count of 12 being received, there is no output on line 38 and inverter 39 causes an output on line 41 to enable AND gate 44 thereby enabling a first voltage, $V_1$, from the power source 28 to be coupled to the LCD display 34 on line 46. This voltage causes the LCD watch face to have a first color. When a count of 12 is received, inverter 39 removes the output signal from line 41 thereby disabling AND gate 44 and removing voltage, $V_1$, from line 46 to the LCD display 34. However, the output from counter 36 on line 38 enables AND gate 42 thereby providing a second different voltage, $V_2$, to be applied to LCD display 34 on line 48 thereby changing the color of the LCD watch face in a well known fashion.

The present invention also relates to a method for improving a dual time piece by providing indicia related to each time piece that gives an indication of whether the time in the time zone represented by each time piece is in the a.m. or p.m. The indicia may be either a window in the face of each time piece in which the letters a.m. or p.m. appear appropriately or, in an LCD dual time piece, the face of one LCD can change in color when the time goes from a.m. to p.m. LCD materials that change color with a change in applied voltage are well known in the art and will not be discussed herein.

Figure 5:
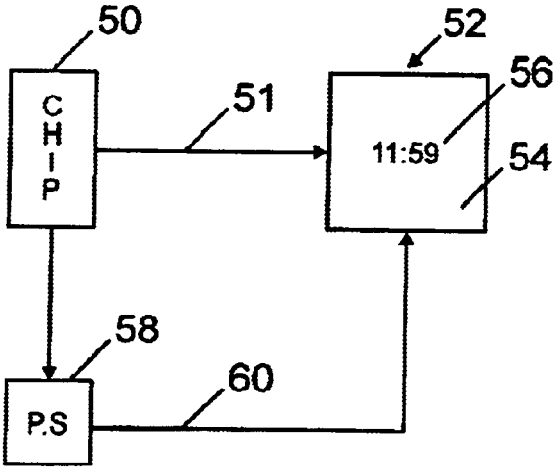
FIG. 5 is a block diagram representation of a simple circuit for causing the LCD display to change color automatically upon the changing of the time between A.M. hours and P.M. hours.
Figure 6:
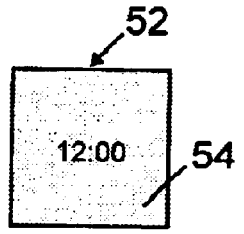
FIG. 6 is a schematic representation of the liquid crystal background having automatically changed from a light color shown in FIG. 5 to another, preferably dark, color, upon the time changing from the A.M. to the P.M.

Another important aspect of the present invention is shown in FIG. 5 and represents an LCD time piece in which the color of the LCD background automatically changes color when the time changes between the A.M. and the P.M. A power supply 58, preferably in the form of a battery but which could also be solar cells, is connected to the LCD background 54 via line 60 to activate the liquid crystal and cause the background 54 to assume a color. An electronic circuit 50, preferably in the form of a computer chip, is coupled to the LCD timepiece 52 by conductor path 51 to cause time related indicia 56 to appear on the LCD background 54. The power supply 58 is also coupled to electronic circuit 50 such that when the time changes between the A.M. and the P.M., the power supply 58 will automatically change the voltage applied to the LCD background 54 to change the color thereof. The nematic crystals of the LCD background display 54 can assume several different colors according to the voltage applied thereto. Anyone of the colors could be selected but the preferred colors are a light color for the A.M. and a dark color for the P.M. Hence, the face of the liquid crystal timepiece will change color automatically whenever the time changes between the a.m. and the p.m.

Figure 7:
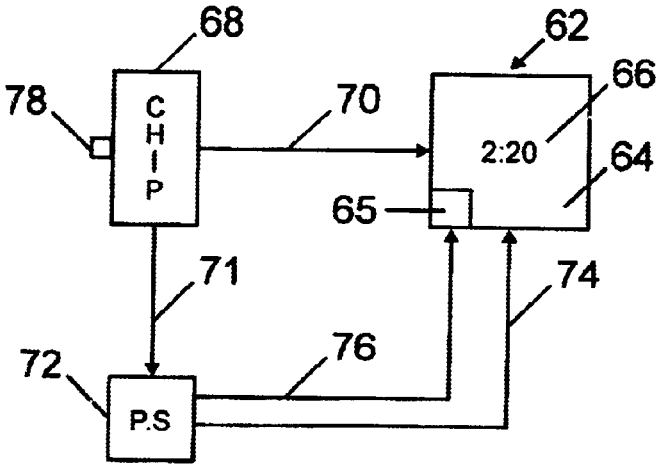
FIG. 7 is a simplified schematic drawing of a user controlled circuit for selectively changing the color of the timepiece face by the user when desired.

In another embodiment shown in FIGS. 7–10, a unique LCD timepiece is disclosed wherein the LCD timepiece face, or portions thereof, can be selectively changed in color to suit the esthetic desires of the timepiece user. Thus, as can be seen in FIG. 7, the LCD timepiece 62 has time related indicia 66 displayed on the LCD background material 64. Again, a well-known electronic circuit 68, preferably in the form of an ASIC control chip, includes a settable clock circuit and is coupled to the timepiece 62 through line 70, to cause time related indicia 66, such as time, to be displayed on the background LCD material 64. Circuit 68 is also coupled to power supply 72 in a well known manner to cause it to supply the proper voltage to the liquid crystal to activate it on line 74 or 76 depending upon the portion of the LCD to be activated.

Figure 8:
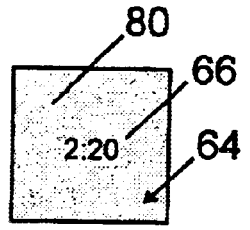
FIG. 8 is one version of a background LCD display having changed to a color as selected by the user thereof.

A manually actuated switch 78 instructs the control chip in a well-known manner to cause the chip to send a control signal to power supply 72 on line 71 to change the amount of voltage supplied by the power supply 72 to the timepiece LCD background display 64. If desired, only a portion 65 of the display 64 could be changed in color with respect to the remainder of the display or, if desired, both the portion 65 and the remainder of the display could be changed in color. The manner is which this voltage is changed is well-known in the art and will not be described here. FIG. 8 illustrates the entire display 64 with the time related indicia 66 being displayed and the remainder 80 of the display being of a dark color representing any color desired by the user and made available by the nematic LCD crystals. Thus the manually controlled electronic circuit 68 selectively causes the power supply 72 to change the voltage applied to at least a portion 65 of the LCD background display 64 thus causing the at least a portion 65 of the display to change color. By sequentially depressing the switch 78, the colors that can be generated or displayed by the nematic LCD crystals can be sequentially selected by the user.

Figure 9:
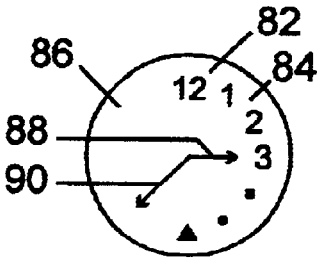
FIG. 9 is another version of an LCD timepiece face that has either numerals or other indicia such as simple geometric figures in the form of dots, squares, and the like that could be changed in color with respect to the remainder of the LCD background display.
Figure 10:
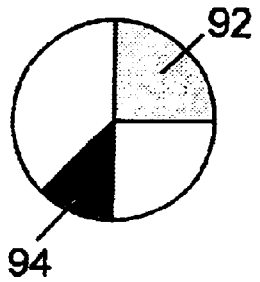
FIG. 10 is still another version of an LCD timepiece face that has portions of the face that are selectively changed in color by the user thereof, such portions including but not limited to each quarter face of the background being a different color or alternate colors or each alternate ⅛th pie shaped section of the LCD face being of one color and the remainder of the pie shaped sections being of another color.

FIG. 9 discloses schematically a timepiece face 82 that has numerals 84, for instance, that can be a color, such as green, with respect to the face 86 of the timepiece. Of course, instead of numerals 84, indicia such as triangles, squares, dots, and the like could be used to indicate hours on the timepiece. Any style or presentation desired could be used such as two contiguous (e.g. circular) groups of numerals with one group having one color for the hour and the other group having another color for minutes. Hour and minute hands 88 and 90, respectively, could be of different selectable colors. The invention is not intended to be limited to any particular combination. For instance, as shown in FIG. 10, quarters 92 could be made to be alternate colors or ⅛th pie shaped segments 94 could alternately be of different colors. Many different patterns may be selected as desired.

Thus, there has been disclosed a novel LCD timepiece that has an LCD face that can automatically change color when the time changes between the A.M. and the P.M. as an esthetic improvement to the looks of the timepiece such as a wrist watch.

In addition, there has been disclosed a novel LCD time piece in which the color of the LCD face, or segments thereof, can be selectively changed by the user. By depressing a control switch, such as a button, associated with the time piece, the color of the display, or portions thereof, can be changed to that desired by the user.

There has also been disclosed a novel dual time piece in which the user, simply by looking at the face of each time piece, can tell whether the time indicated is in the a.m. or p.m. Indicia can be placed on the face of each time piece to represent a.m. or p.m. simply by looking at the time piece face. The indicia could be, for example only, a window in the face of each time piece in which the appropriate letters "a.m." or "p.m." appear or the face of an LCD time piece could be caused to change from one color representing "a.m." to another color representing "p.m.".

As used herein, the terms "LCD display", "LCD display background", and "LCD face" are all intended to mean that portion of the LCD display on which the time related indicia appears unless otherwise expressly stated such as where the time related indicia can be the LCD material that is changed in color.

What is claimed is:

1. A time piece comprising:

a liquid crystal background display (LCD) having contiguous portions that change color when a voltage value applied thereto is changed;

a power supply coupled to said background display for activating said liquid crystal;

a settable clock circuit coupled to said LCD background display for causing time related indicia to be displayed thereon; and an electronic circuit coupled to said clock circuit and to said power supply to change the voltage value applied to at least a selected one of said contiguous portions of said liquid crystal background display for automatically changing the color of any selected ones of said contiguous portions of said liquid crystal background display only when said clock circuit indicates a change of time between A.M. hours and P.M. hours.

2. The timepiece of claim 1 wherein said at least a portion of said liquid crystal background display changes color with respect to said time related indicia.

3. The timepiece of claim 1 wherein said at least a portion of said liquid crystal background display that changes color is only said time related indicia.

4. A timepiece comprising:

a liquid crystal background display (LCD) having contiguous portions that change color when a voltage value applied thereto is changed;

a power supply coupled to said liquid crystal background display for activating said liquid crystal;

a settable clock coupled to said LCD background display for causing time related indicia to be displayed thereon; and an electronic circuit coupled to said power supply and to said clock for automatically causing the power supply to change the voltage value applied to any selected ones of said contiguous portions of said liquid crystal background display only when said clock indicates a change in time between A.M. hours and P.M. hours thereby providing a first color of said any selected display portion only when said time is in the A.M. hours and a second color of said any selected display portion only when said time is in the P.M. hours.

5. The timepiece of claim 4 wherein said first color is a light color and said second color is a dark color compared to said light color.

6. A method of presenting time related indicia on an LCD timepiece comprising the steps of:

providing the timepiece with a liquid crystal display having contiguous portions that are changeable in color when a voltage applied thereto is changed in value and that has time related indicia associated therewith;

providing a clock circuit for causing said time related indicia to indicate time; and causing said clock circuit to automatically change the voltage value applied to any selected ones of said contiguous portions of said liquid crystal display of said timepiece only when there is a change in time between A.M. hours and P.M. hours thereby causing said any selected liquid crystal display portion to have one color for the A.M. hours and a different color for the P.M. hours.

* * * * *